United States Patent [19]

Brown

[11] Patent Number: 4,832,812

[45] Date of Patent: May 23, 1989

[54] APPARATUS FOR ELECTROPLATING METALS

[75] Inventor: Craig J. Brown, Ontario, Canada

[73] Assignee: Eco-Tec Limited, Pickering, Canada

[21] Appl. No.: 188,333

[22] Filed: May 4, 1988

Related U.S. Application Data

[62] Division of Ser. No. 93,664, Sep. 8, 1987.

[51] Int. Cl.[4] ..... C25O 17/00

[52] U.S. Cl. ..... 204/237; 204/263; 204/275

[58] Field of Search ..... 204/232, 237, 252, 259, 204/263, 275

[56] References Cited

U.S. PATENT DOCUMENTS

| | | | |
|---|---|---|---|
| 4,328,076 | 5/1982 | Fisher | 204/14.1 |
| 4,514,266 | 4/1985 | Cole | 204/14.1 |
| 4,609,443 | 9/1986 | Nogueira | 204/104 |

OTHER PUBLICATIONS

Crouch, P. C., Hendrickson, M.V., Effect of Brighter Systems on the Cathode and Anode Efficiencies of Nickel Plating Solutions, May 1983.

Toivanen, NickelRefining in Finland, The Canadian Mining and Metallurgical Bulletin, Jun. 1964.

Boldt, J. R., Queneau, P. E., The Winning of Nickel, 1967.

Modern Electroplating, Edited by F. A. Lowenheim, pp. 41–43, 1974.

*Primary Examiner*—T. M. Tufariello

*Attorney, Agent, or Firm*—Rogers, Bereskin & Parr

[57] ABSTRACT

An apparatus for electroplating metals in an electroplating bath having an anode and a cathode. The cathode is formed by a workpiece to be plated and the anode includes soluble material in the form of the metal to be plated and insoluble material in a proportion selected so that the anode efficiency equals the cathode efficiency. This avoids metal salt build-up in the bath. Metal salt solution carried out of the bath with the workpiece is recovered and recycled to the bath, avoiding loss of metal to the system and waste disposal problems.

7 Claims, 10 Drawing Sheets

APPARATUS FOR ELECTROPLATING METALS

This is a division of application Ser. No. 093,664 filed Sept. 8, 1987.

FIELD OF THE INVENTION

This invention relates to an apparatus for electroplating metals.

BACKGROUND OF THE INVENTION

Electroplating is a well-known process used, for example, to nickel plate workpieces such as automotive parts that are required to have a "bright" finish. In a typical example of this particular application of the process, the workpiece passes successively through one or more nickel plating baths and associated rinse baths. In each case, the bath contains a nickel salt solution and a nickel anode. The workpiece acts as the cathode and is electroplated by connecting a source of direct electric current between the cathode and anode. In one particular plating system, the workpiece receives a thin nickel coating in a first bath (often called the "nickel strike"). Additional nickel is deposited on the workpiece in the second and third baths which are referred to respectively as the "semi-bright" and "bright" baths. The nickel salt solutions in these baths contain organic "brightners".

In a commercial nickel plating operation, plating is carried out on a "batch" basis. For example, a batch of automotive parts such as bumpers may be carried by a single rack by which they are transported from bath to bath. The bumpers are electrically connected together to effectively form a single cathode and are all electroplated at the same time. As the workpieces leave the plating baths a thin film of plating solution remains on the surface. This is referred to as "dragout". Some dragout occurs no matter what the shape of the workpiece, but the amount can be substantial with workpieces of unusual shapes. Liquid transfer into a bath in this way is referred to as "dragin".

Dragout from metal plating baths represents a significant cost in terms of the value of the lost metal as well as the cost of treatment of the water used to rinse the workpieces after they have been plated. Probably even more significant is the cost and difficulty of disposal of hazardous metal hydroxide waste sludge that conventional waste treatment systems produce.

Despite the depletion effect of dragout from the plating baths, in some cases, it is unnecessary to add metal salt to the plating bath because the metal concentration in the bath tends to increase naturally due to poor cathode efficiency. In extreme cases, it may even be necessary to periodically decant some of the plating solution and replace it with water to prevent a build-up in the metal concentration in the plating bath.

BRIEF DESCRIPTION OF THE INVENTION

It has now been recognized that it is possible to improve the process described previously so as to address both the problem of metal loss due to dragout and disposal of waste from the process According to the invention there is provided an apparatus for electroplating metals in which at least one electroplating bath is provided and has an anode including soluble anode material in the form of the metal to be plated, and insoluble anode material. A cathode comprising a workpiece to be plated is introduced into the bath. The proportion of soluble anode material to insoluble anode material is selected so that the anode efficiency is substantially equal to the cathode efficiency during electroplating. After electroplating, the workpiece is removed from the bath and rinsed with rinse water. Successive workpieces are electroplated, removed from the bath and rinsed in this way. The rinse water is treated to recover metal salt carried from the electroplating bath by the cathodes and the metal salt is recycled to the electroplating bath to maintain the metal/salt concentration in the bath within required limits.

In the context of the invention, the term "efficiency" in relation to an electrode is considered as having its normal meaning in the art, namely the ratio of the useful current transferred between the electrode and the electrolyte to the current supplied to the electrode (usually expressed as a percentage).

Referring by way of explanation to a nickel plating bath as an example, the electrode reactions are as follows:

$$\text{anode Ni metal} — Ni^{++} + 2e^- \quad (1)$$

$$\text{cathode } Ni^{++} + 2e^- — \text{Ni metal} \quad (2)$$

$$2H^+ + 2e^- — H_2\text{gas} \quad (3)$$

At 100% cathode efficiency reaction (3) does not occur. Under conditions of 100% cathode efficiency and 100% anode efficiency, nickel is plated out at the cathode at the same rate that it is dissolved from the anode and the pH will remain constant. If the effect of dragout is neglected, the concentration of dissolved nickel in the bath should not change. However, under practical circumstances, the anode efficiency does in fact approach 100% in a conventional process, but the cathode efficiency usually falls to the 93–97% range (see Crouch, P. C., Hendrickson M. V., "Effect of Brightener Systems on the Cathode and Anode Efficiencies of Nickel Plating Solutions", Trans. Inst. of Metal Finishing, 1983, Vol 61.). This results in nickel build-up in the bath.

As noted above, in the present invention, the effective anode efficiency is "matched" to the cathode efficiency. This is achieved by lowering the effective anode efficiency by employing insoluble anode material. The proportion of insoluble anode material required may be determined by selecting the amount of insoluble material that results in the current carried by the soluble material being equal to the current that results in actually plating metal. Another method involves calculating the area of insoluble anode material that is required to make the anode efficiency equal to the cathode efficiency (see later). Generally, the insoluble anode area will represent less than 10% of the total anode area.

The possible reactions at an insoluble anode in a solution containing sulfate and chloride anions are:

$$2H_2O — O_2\text{gas} + 4H^+ + 4e^- \quad (4)$$

$$2Cl^- — Cl_2\text{gas} + 2e^- \quad (5)$$

It has been predicted that evolution of chlorine gas will take place if the concentration of chloride ions is above 25% of the concentration of sulfate ions (see Dennis J. K., Such T. E., "Nickel and Chromium Plating", Newnes-Butterworth, 1972). In a normal Watts nickel plating bath the ratio of sulfate to chloride ion is about 4 to 1, so that some chlorine evolution may be expected. Chlorine may have a tendency to oxidize organic addition agents. Some brighteners can tolerate much more anodic polarization than others. Coumarin, for example (an additive commonly employed in semi-bright nickel plating baths) is known to be particularly subject to electrolytic degradation (see Wu S. H. L., Billow E., Garner H. R., "Automatic Purification of Coumarin Containing Nickel Plating Baths" Plating,).

As will be discussed later, as a result of practical tests, it was concluded that it will be possible to maintain the important sulfate to chloride ratio in nickel plating with the result that chlorine evolution will be insignificant and additional ventilation of tee nickel plating baths will not be required.

Another possible difficulty with the use of insoluble anodes is that an adverse reaction may occur between some anode materials and some organic brightners typically used in nickel plating baths. As will be described later, the invention addresses this problem by providing means for isolating the insoluble anode to prevent any such adverse reaction.

BRIEF DESCRIPTION OF THE DRAWINGS

In order that the invention may be more clearly understood, reference will now be made to the accompanying drawings which illustrate a number of preferred embodiments of the invention by way of example, and in which.

DESCRIPTION OF THE PREFERRED EMBODIMENTS

Figure 1:
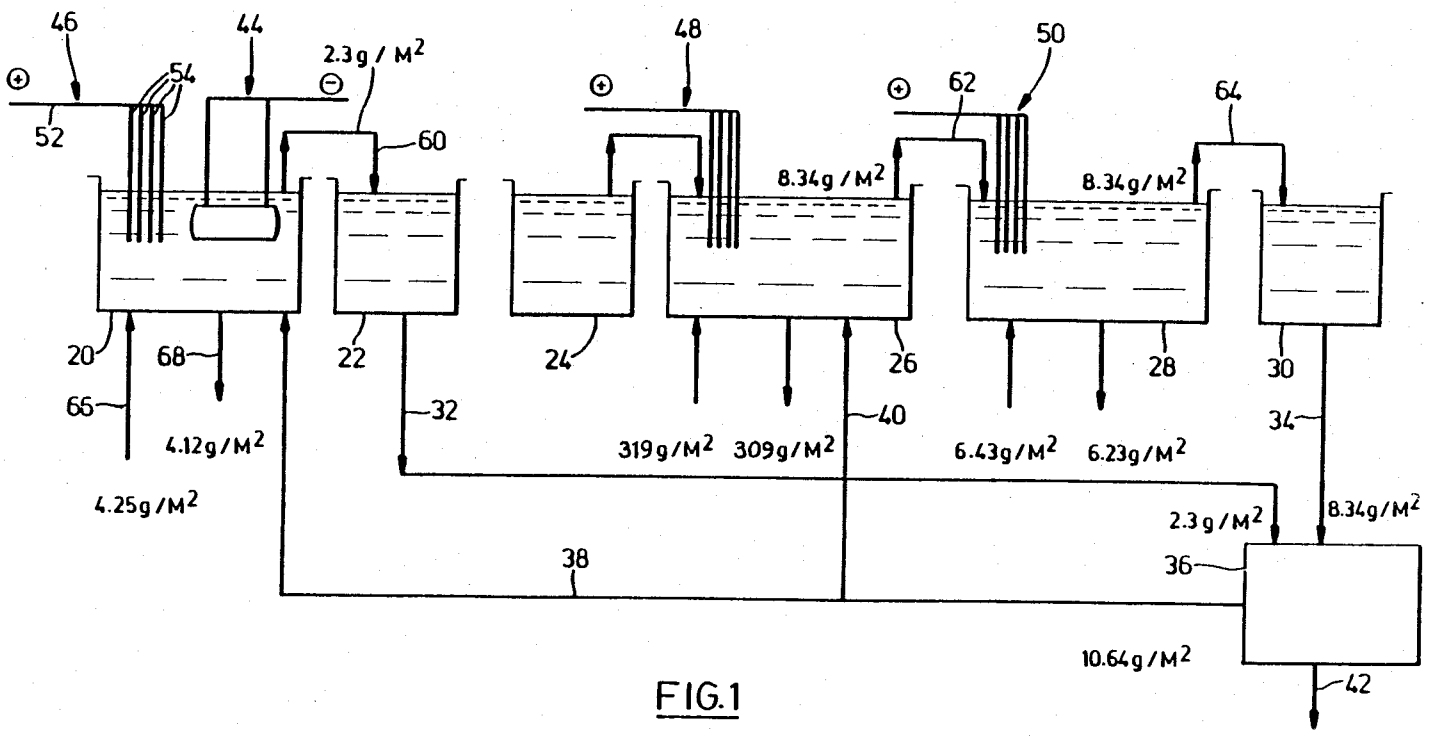
FIG. 1 is a diagrammatic illustration of an apparatus for use in performing the process of the invention.

Referring to the drawings, FIG. 1 illustrates the principal components of a nickel plating apparatus for performing the process of the invention. Electroplating is carried out in three stages, each of which involves plating of a workpiece in a nickel plating bath, and an associated rinse step. The first stage is referred to as the "nickel strike" and is carried out in a plating bath denoted 20, followed rinsing in a rinse bath 22. The next stage is a second rinse in a bath 24, followed by "semi-bright" nickel plating in a bath 26. The third stage is "bright" nickel plating in a bath 28 followed by rinsing in a final rinse bath 30. Reference numeral 32 denotes an effluent line from the first rinse bath 22 while numeral 34 denotes a similar effluent line from the final rinse path 30. The two lines 32 and 34 are taken to a waste treatment unit 36 in which nickel is recovered and recycled to the first and second plating baths 20 and 26 respectively through lines 38 and 40. Waste effluent from the waste treatment unit 36 is discharged at 42.

As discussed previously, each of the nickel baths 20, 26 and 28 contains solution of nickel salt and the baths 66 and 28 also contain organic "brighteners" all as is conventional in the art.

Each plating bath also has an anode structure that is "fixed" in the sense that it remains in the bath during the plating operation. The cathode on the other hand is formed by a rack or support that carries one or more workpieces to be plated and that is moved through the baths in succession as the plating operation proceeds. The particular form of rack or support for the workpiece is conventional and forms no part of the present invention. It has therefore been illustrated diagrammatically only in the first plating bath 20 and is denoted by reference numeral 44. The fixed anodes in the three plating baths are denoted respectively 46, 48 and 50 and are shown as composite anode structures comprising a bus bar from which is suspended individual anode elements. For example, referring to anode structure 46, the bus bar is denoted 52 and the individual anode elements are denoted 54.

Figure 2:
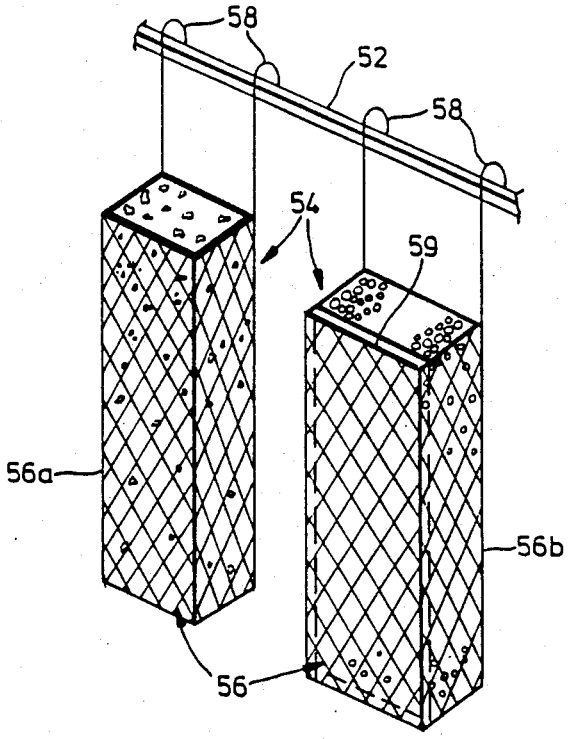
FIG. 2 is a perspective view of a typical anode used in the apparatus shown in FIG. 1.

FIG. 2 shows part of bus bar 52 and two of the anode elements 54. In this case, the elements take the form of wire baskets 56 that are suspended by hooks 58 from the bus bar 52 so as to be electrically connected thereto. One of the baskets, denoted **56*a*, contains nickel chips forming soluble anode material. The other basket, denoted 56*b*, is identical with basket 56*a* but contains inert glass balls that in effect hold against a front wall of the basket an insoluble anode plate 59 of iridium oxide coated titanium, (manufactured by ELTECH Systems Corporation of Chardon, Ohio under the trade mark DSA). Plate 59 could alternatively comprise a titanium substrate coated with ruthenium oxide. Although only two baskets have been shown in FIG. 2**, there will of course be more baskets containing soluble anode material since this represents the majority of the anode area.

Referring back to FIG. 1, the arrows shown extending from one bath to the next (except between the two rinse baths 22 and 24) represent transfer of liquid from bath to bath with the cathode ("dragout" and "dragin"). For illustration purposes, possible typical numerical values have been shown to illustrate the total dragout from the system. For example, the arrows denoted 60 show a dragout of 2.3 grams of nickel per square meter of cathode area from the nickel strike bath 20 to the rinse bath 22. Assuming all of the dragout is removed in the rinse bath, there is a corresponding loss to waste line 32. Typical values for dragout from the semi-bright bath 26 and dragin to the bright bath 28 are shown by arrow 62. Corresponding dragout from bath 28 is shown by arrow 64 and also goes to waste from the rinse bath 30.

Referring to the nickel strike bath 20, arrow 66 represents 4.25 grams/$m^2$ of nickel being added to the solution from the anode structure 46 during electroplating, while arrow 68 shows 4.12 grams/$m^2$ of nickel being plated onto the cathode. Typical values are similarly shown for the other two plating baths 26 and 28.

A consideration of the material balance in the overall nickel plating operation illustrates the nickel that would be lost to the system if the nickel removed by the rinse baths 22 and 30 could not be recycled.

---

Dragout from Semi-Bright and Bright Ni
$(0.1\ L/m^2) \times (83.4\ g/L\ Ni) = 8.34\ g/m^2$
Plating (Semi-Bright)
$(1.095\ g/AH) \times (35\ A/ft^2) \times (0.75\ H) \times (10.76\ ft^2) = 309\ g/m^2$
Ni Strike Dragout
$(0.1\ L/m^2) \times 23\ g/L\ Ni) = 2.3\ g/m^2$ -continued

| |
|---|
| Ni Strike Plating |
| (1.095 g/AH) × 25 A/ft$^2$) × (0.014 H) × (10.76 ft$^2$/m$^2$) = 4.12 g/m$^2$ |
| Total Dragout = bright + strike |
| = 8.34 + 2.3 |
| = 10.64 g/m$^2$ |

[L = liters; A = amperes; H = hours]

Typical semi-bright/bright cathode efficiency is 97% (95–98%). Since anode efficiency will be 100% in a conventional process, the nickel anodes in the semi-bright bath will dissolve faster than nickel is plated at the cathode at the rate of 3%×309=9.27 g/m$^2$. As a result the dissolved nickel will build up to a small extent in the semi-bright bath at the rate of 9.27−8.34=0.93 g/m$^2$ (if no dragout is recycled).

If dragout is to be recycled, the rate of nickel dissolution must be reduced by 9.27 g/m$^2$. Three percent of the nickel anode area must be replaced by insoluble anode to prevent unacceptable nickel build-up in the bath.

In this context, "anode area" is considered to be the are of the anode that faces the cathode. In the particular example being described, the area of soluble material will be an approximation due to the irregular nature of the surface area of the nickel chips used.

Nickel recovery in the waste treatment unit 36 can be effected using various known processes such as ion exchange, reverse osmosis, electrodialysis and evaporation. Reference may be made to U.S. Pat. Nos. 3,385,788, 3,386,914 and 4,186,174 issued to Robert F. Hunter which disclose examples of suitable ion exchange processes. With ion exchange, the nickel can be recovered in the form of a metal sulfate or chloride salt liquid concentrate and recycled in this form.

It is also feasible to operate the first rinse following the nickel plating bath as a stagnant or "recovery" rinse. The nickel concentration will build up in this rinse to a concentration of several grams per liter nickel. This nickel bearing rinse water can then be used to replace evaporative water losses in the nickel plating baths, which are appreciable. The rinse tank is then topped up with fresh water. Final rinsing of the workpieces is accomplished in subsequent flowing rinses as described above. Although this technique is not as efficient as employing a method such as ion exchange, this technique provides a means to inexpensively recover some of the nickel dragout.

Figure 3:
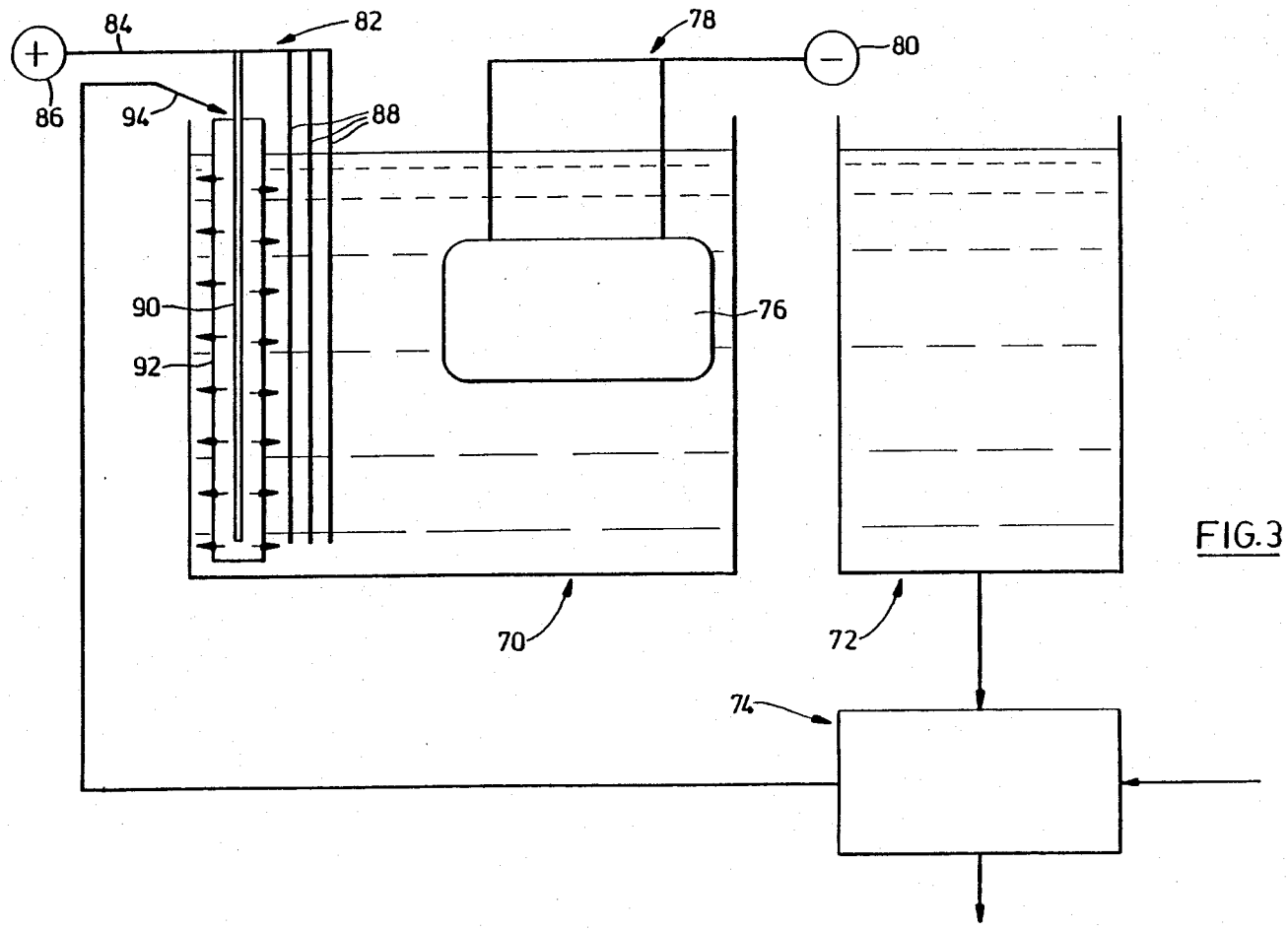
FIG. 3 is a diagrammatic illustration of a nickel plating apparatus showing an alternative form of anode structure.

As noted previously, adverse reaction may take place between some insoluble anodes and some organic brighteners. For example, addition agents such as that sold under the trade mark DEN-BRITE rapidly deteriorate the iridium oxide coating on a DSA anode. It is therefore proposed to isolate the insoluble anode material to prevent interaction between it and the organics in the electroplating solution. FIG. 3 illustrates one way in which this can be achieved.

As shown in that view, a single nickle plating bath is shown at 70 in association with a rinse bath 72 and a waste treatment unit 74 in the form of an ion exchanger. A workpiece to be plated is shown diagrammatically at 76 and is carried by support 78 by which it is connected to the negative side of a rectifier as indicated at 80.

The bath has an anode structure generally denoted 82 that includes a bus bar 84 connected to the positive side of a rectifier as indicated at 86. Suspended from the bus bar are a series of nickel anodes shown in this case as nickel plates 88, and an insoluble anode 90 which may for example take the form of a DSA plate. The part of plate 90 that is immersed in the electroplating solution is enclosed is a porous bag 92 made of a suitable corrosion resistant cloth such as polypropylene. Recycled nickel sulfate/chloride solution from the ion exchanger 74 is delivered into the open upper end of bag 92 as indicated diagrammatically at 94. This porous nature of bag 92 allows the influent solution to flow out through the bag. In this way, the flow of liquid will be always away from the insoluble anode and the anode will "see" only the sulfate/chloride "anolyte" solution and will be isolated from agents within the bath with which the anode might adversely react.

Figure 10:
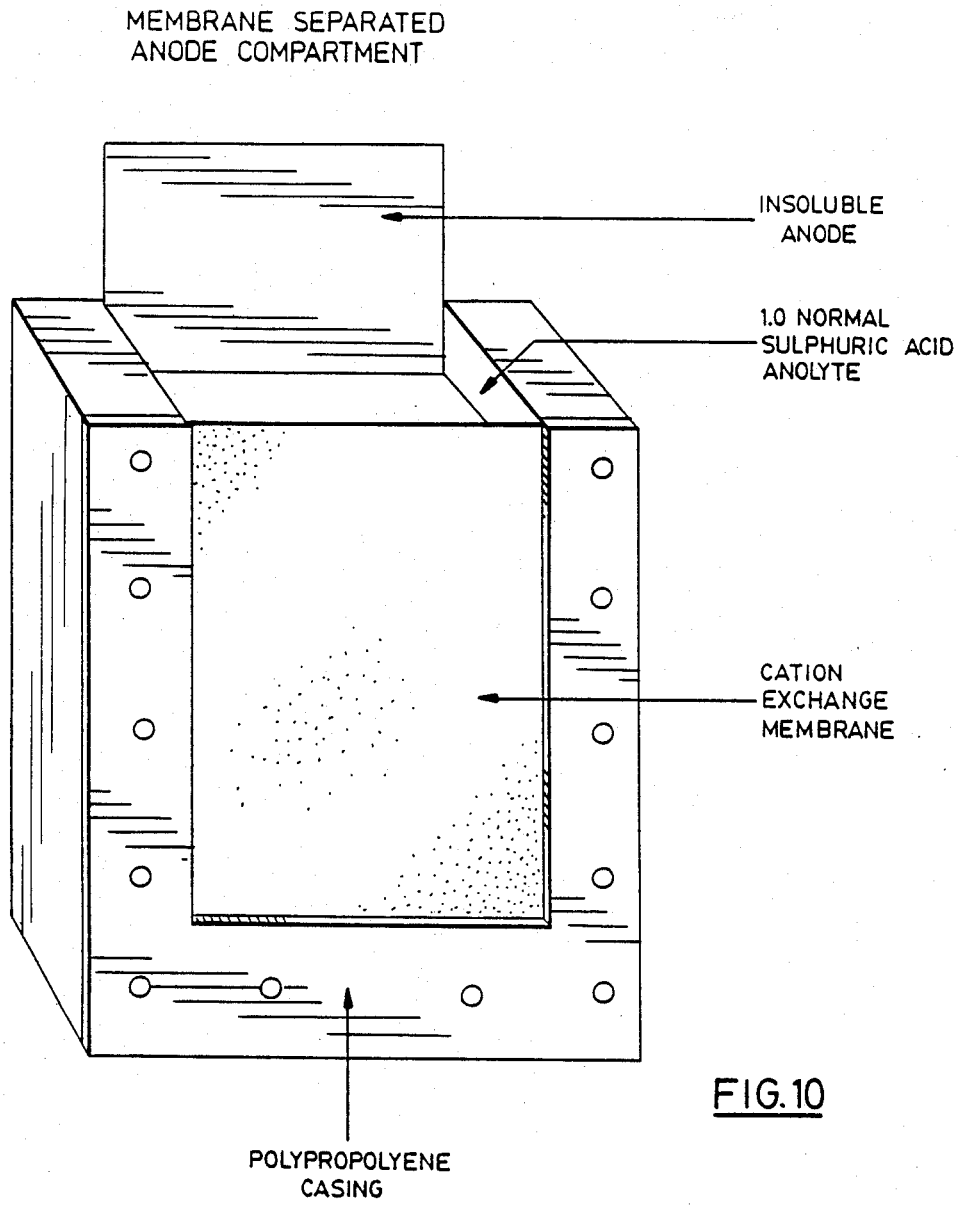

As an alternative to the arrangement illustrated in FIG. 3, the bag 92 may be replaced by a non-porous barrier (e.g. ion exchange membrane) that will allow electron flow while at the same time protecting the anode from organics within the bath. The recycled nickel sulfate/chloride solution can be allowed to flow directly into the bath. A dilute sulfuric acid solution is placed inside the bag. A suitable barrier is a cation exchange membrane available from Dupont under the trade mark NAFION or MC-3470 from the Ionac Chemical Division of Sybron Corporation. Another possibility is to use a membrane separated anode compartment such as that shown in FIG. 10 (to be described).

CALCULATION OF PROPORTION OF INSOLUBLE ANODE MATERIAL REQUIRED

The proportion of insoluble anode material required is such that the current passed by the insoluble anode material will be approximately the same as the difference between the anode and cathode efficiency. This is usually expressed in terms of "anode area" since the part of the anode that faces the cathode is the part from which current flows during electroplating. For most nickel plating baths the anode efficiency is essentially 100% and the cathode efficiency can be anywhere from 93–97%. The actual cathode efficiency will depend on a number of factors including the brightener system used and the amount of foreign contamination in the bath. The cathode efficiency can be calculated easily knowing the consumption of sulfuric or hydrochloric in the plating bath.

Sulfuric or hydrochloric acid is regularly added to nickel plating solutions to make-up for the hydrogen ions reduced to hydrogen gas at the cathode. Therefore the amount of sulfuric acid added over a long period of time is a good indication of the cathode efficiency.

For example, in a given nickel plating bath 80 liters of concentrated (36N) sulfuric acid is normally added to the bath over 200 hours of operating time. The average electrical current to the bath during the 200 hours was 1200 amps.

80 L×36 eq/L÷200 H=14.4 eq/H of hydrogen ion reduced 12,000 amp÷96,487 amp sec/eq×3600 sec/H=448 eq/H current to cathode 14.4÷448×100%=3.2% of total current goes to production of hydrogen gas Cathode efficiency=100−3.2=96.8%

EXPERIMENTS

Reference will now be made to a series of tests that were conducted to determine the effect of utilizing a small percentage of insoluble auxiliary anode on a semi-bright nickel plating solution, a bright nickel plating solution, and a bright acid copper plating solution.

An insoluble anode system used in any plating solution must have the following characteristics:

1. The anode must not appreciably increase the consumption of organic brighteners.

2. It must not adversely affect the chemistry of the bath either by excessive chlorine evolution or by the dissolution of harmful metallic impurities.

3. The cost of the anode must be low compared to the cost of the metals (copper, nickel, etc.) saved.

Ideally the anode alone will fulfill these requirements. However, the anode bag solution recovery system described earlier can be used to protect the anode from the brightener or vice versa if anode deterioration is a problem (Item 3).

EXPERIMENTAL PROCEDURE

The testing was conducted in four stages. The first was a comparison of the rate of consumption of Coumarin in plating cells containing a small portion of graphite or DSA anode with that of a normal plating cell containing 100% nickel anodes.

A semi-bright Watts nickel plating solution containing Coumarin brightener was obtained from a large electroplating operation. The test cell (FIG. 4) held 66 liters of solution. Stainless steel and nickel sheets were employed as cathodes. The primary anode was electrolytic grade nickel sheet. The solution pH was maintained between 3.5 and 4.5 and the temperature between 55° C. and 65° C. The Coumarin level was maintained by regular additions of Coumarin powder.

To simulate a normal plating cell a nickel anode and cathode, both approximately three square feet in area, were placed in the cell. The current density was maintained at 50 ASF (amperes per square foot), and the Coumarin level was analyzed with a spectrophotometer. Next a small portion of the nickel anode was replaced with graphite and the procedure was repeated. Three types of rectangular graphite rod (0.11 square foot area), and a cross-section of a graphite anode commercially employed in trivalent chrome plating (0.16 square foot area) were tested. Finally the anode and cathode areas were reduced to 1.5 square feet while the current density was maintained at 50 ASF. A 0.06 square foot strip of iridium oxide coated titanium (DSA) sheet was used in conjunction with the nickel and once again the coumarin consumption was measured.

In the second stage of testing, DSA anodes were subjected to extremely high current densities in semi-bright nickel, bright nickel, and bright acid copper plating solutions. In normal plating applications the anode current density is around 50 ASF. By forcing 500 ASF current through the anode, the anode deterioration is accelerated allowing anode life to be estimated in reduced time.

The semi-bright nickel solution used was the same Coumarin based solution from the previous test. The bright nickel solution was a Harshaw formulated DBN-brite containing the proprietary brighteners LC-30, DBN-81 and DBN-82C. The acid copper used was also a Harshaw formulation containing the proprietary brighteners EK-B and EK-C.

In the third stage of testing, various types of polypropylene cloth and a sintered porous polypropylene tube manufactured by Porex Technologies were evaluated for possible use in the anode bag system for separating the insoluble anode from the bulk of the plating solution, particularly the organic brighteners. The cloth materials were sewn into the form of a straight sock and one end of the Porex tube was plugged so they all had the same basic shape. These "anode bags" were immersed in a bright nickel plating solution with only the open end kept above the solution level. The bright nickel solution was chosen because it rapidly deteriorated the DSA coating in the previous test.

Pure nickel sulfate solution was pumped into the top of the anode bag (or sock) and measurements were taken of the internal and external brightener concentration. The basis for comparison between materials was the solution flux which is defined as the flow of solution into the bag in liters/hr divided by the submerged area of the bag in $ft^2$. In other words it is the net outward flow of solution from inside the anode bag through a given area of the bag. The best material would be the one which maintained the lowest internal brightener concentration when all were compared at the same flux.

Figure 4:
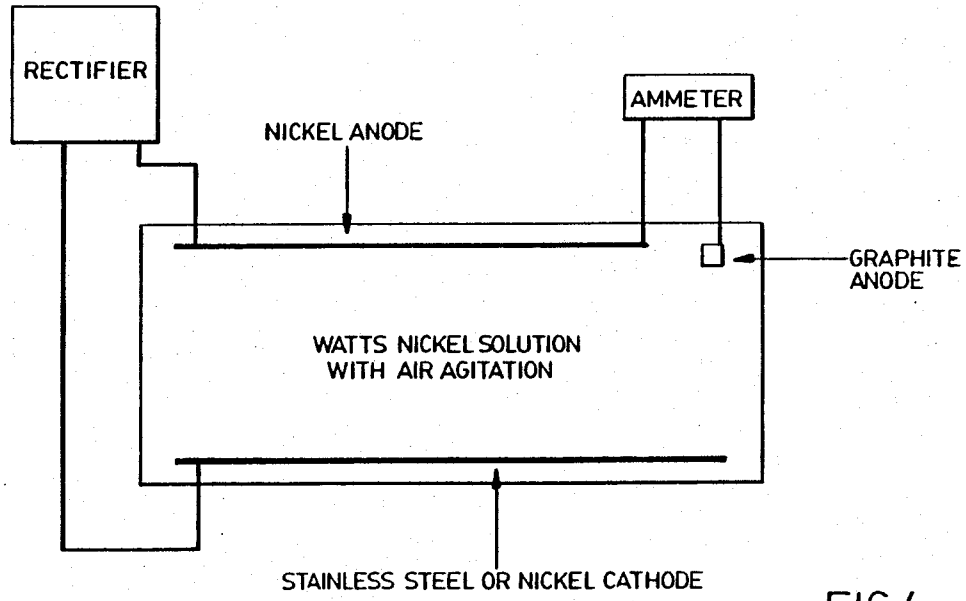
FIG. 4 is a diagrammatic illustration of an experimental apparatus which is referred to later under the heading "Experimental Procedure"

Once the best material was established, a portion of DSA anode was placed in the bag in a simulation of the system shown in FIG. 4. A 40 g/L nickel sulfate solution was pumped into the bag at a rate comparable to the dragout rate expected in a plating solution. The current density was maintained at 500 ASF to compare to the accelerated life test done without the anode bag system.

In the fourth stage, an anode compartment was constructed and was used as an anode "basket", for example in place of the basket denoted **56*b* in FIG. 2. The compartment or basket had polypropylene walls on three sides and the bottom. On the fourth side of the basket, facing the cathode, a cation exchange membrane (Ionac MC-3470) was fixed and sealed to the polypropylene as illustrated if FIG. 10**. An insoluble (DSA) anode was suspended inside the basket and the basket was filled with dilute (0.1 - 1.0 N) sulfuric acid to provide a solution of good electrical conductivity between the anode and the membrane.

In the ion exchange membrane system, the recovered nickel salt solution is admitted directly to the bulk plating solution. The recovered nickel salt solution may contain brighteners since it does not contact the anode directly and will therefore not adversely effect anode life. This anode assembly was operated in the Harshaw DBN-brite plating solution to determine if the membrane would adversely effect the current carrying characteristics of the anode and if the membrane would reject the organic additions agents sufficiently to protect the anode.

RESULTS

The results are summarized in the following tables which are numbered 1, 2, 3, 4 and 5 and in FIGS. 5, 6, 7, 8 and 9.

TABLE 1

COUMARIN CONSUMPTION - EFFECT OF GRAPHITE ANODE

| DATE | AVERAGE COUMARIN CONC [g/l] | COUMARIN CONSUMED [g] | TEST LENGTH [hrs] | GRAPHITE ANODE CURRENT [amps] | GRAPHITE ANODE CD [amps/sq ft] | TOTAL CURRENT [amps] | COUMARIN CONSUMED [g/amp-hrs] |
|---|---|---|---|---|---|---|---|
| 100% Nickel Anode | | | | | | | |
| Jan-20 | 0.0875 | 6.01 | 4.75 | — | — | 150 | 0.0084 |
| Jan-20 | 0.024 | 2.37 | 11.91 | — | — | 150 | 0.0015 |
| Jan-21 | 0.2228 | 14.39 | 4.5 | — | — | 150 | 0.0213 |
| Jan-23 | 0.0809 | 3.4 | 2.5 | — | — | 150 | 0.0091 |
| Mar-09 | 0.134 | 6.05 | 3.2 | — | — | 75 | 0.0252 |
| Mar-11 | 0.1204 | 8.6 | 5 | — | — | 75 | 0.0229 |
| Grade #1 Graphite Anode, 3.6% of Total Anode Area | | | | | | | |
| Jan-23 | 0.0845 | 1.34 | 1 | 4 | 38 | 150 | 0.009 |
| Jan-26 | 0.1635 | 2.45 | 1 | 8 | 76 | 150 | 0.0163 |
| Jan-26 | 0.1312 | 1.82 | 1 | 8 | 76 | 150 | 0.0121 |
| Jan-28 | 0.1248 | 7.6 | 3 | 5.5 | 50 | 150 | 0.0169 |
| Jan-28 | 0.1793 | 9.15 | 3 | 5.5 | 50 | 150 | 0.0203 |
| Jan-28 | 0.1624 | 12.98 | 5.25 | 5.5 | 50 | 150 | 0.0164 |
| Jan-28 | 0.0825 | 2.77 | 2 | 5.5 | 50 | 150 | 0.0092 |
| Trivalent Chrome Plating Graphite Anode, 5/2% of Total Anode Area | | | | | | | |
| Feb-13 | 0.132 | 11.1 | 5.5 | 7 | 44 | 150 | 0.0135 |
| Feb-16 | 0.1135 | 28.3 | 13.2 | 7 | 44 | 150 | 0.014 |

TABLE 2

COUMARIN CONSUMPTION - EFFECT OF DSA ANODE

| DATE | AVERAGE COUMARIN CONC [G/L] | COUMARIN CONSUMED [G] | TEST LENGTH [HRS] | DSA ANODE CURRENT [AMPS] | DSA ANODE CD [ASF] | TOTAL CURRENT [AMPS] | COUMARIN CONSUMED [G/AMP-HR] |
|---|---|---|---|---|---|---|---|
| 4% DSA Anode | | | | | | | |
| Feb-25 | 0.1553 | 7.98 | 4.25 | 4.3 | 72 | 92 | 0.0204 |
| Feb-27 | 0.1046 | 2.8 | 3.5 | 4 | 67 | 75 | 0.0107 |
| Feb-27 | 0.122 | 6.09 | 4 | 5 | 83 | 75 | 0.0203 |
| Mar-09 | 0.122 | 4.11 | 4 | 4 | 67 | 75 | 0.0137 |
| Mar-09 | 0.147 | 11.02 | 6.5 | 4 | 67 | 75 | 0.0226 |
| Mar-11 | 0.123 | 9.8 | 6.3 | 4 | 67 | 75 | 0.0208 |
| 100% DSA Anode | | | | | | | |
| Feb-27 | 0.1 | 0.46 | 2.25 | 30 | 500 | 30 | 0.0068 |
| Feb-27 | 0.162 | 11.4 | 16.2 | 30 | 500 | 30 | 0.0236 |
| Mar-11 | 0.144 | 17.7 | 24 | 30 | 500 | 30 | 0.0246 |

TABLE 3

GRAPHITE TESTING SUMMARY

| GRADE | TIME [HRS] | AVG. CURRENT DENSITY [ASF] | ANODE CONDITION |
|---|---|---|---|
| CS | 18.3 | 58 | ERODED |
| TRI-CHROME | 26 | 38 | ERODED |
| ATJ | 21 | 58 | ERODED |
| PHENOLIC RESIN IMPREGNATED CS GRADE | 90 | 55 | ERODED, 18% WEIGHT LOSS |

TABLE 4

DSA ANODE ACCELERATED LIFE TEST

| | |
|---|---|
| INITIAL WEIGHT | 42.104 GMS |
| FINAL WEIGHT | 42.097 GMS |
| TEST LENGTH | 240 HRS |
| AVG. CURRENT DENSITY | 500 ASF |

TABLE 5

Anode Bag Testing in Bright Nickel Solution

| | REGULAR ANODE BAG | SPUN POLY-PROPYLENE | POLYPROPYLENE MULTIFILAMENT | | | | | SINTERED POROUS POLYPROPYLENE TUBE | |
|---|---|---|---|---|---|---|---|---|---|
| CFM RATING | 20–30 | 5–7 | | | 2–3 | | | | |
| AREA [SQ FT] | 0.24 | 0.65 | | | 0.125 | | | 0.125 | 0.125 |
| SOLUTION FLOW [L/HR] | 0.69 | 2.4 | 0.33 | 0.41 | 0.41 | 0.2 | 0.44 | 0.33 | 0.26 |
| FLUX [L/HR/SQ FT] | 2.9 | 3.7 | 2.6 | 3.3 | 3.3 | 1.6 | 3.5 | 2.6 | 2.1 |
| SOLUTION TEMP [C.] | 25 | 25 | 60 | 60 | 60 | 60 | 60 | 60 | 60 |
| EXTERNAL SACCHARIN [G/L] | 2.51 | 2.38 | 21 | 2.1 | 2.5 | 2.1 | 2.6 | 2.1 | 2.1 |
| INTERNAL | 2.38 | 1.36 | 0.5 | 0.29 | 0.44 | 0.52 | 0.21 | 1.1 | 1 |

TABLE 5-continued

| | Anode Bag Testing in Bright Nickel Solution | | | | | | | | |
|---|---|---|---|---|---|---|---|---|---|
| | REGULAR ANODE BAG | SPUN POLY-PROPYLENE | POLYPROPYLENE MULTIFILAMENT | | | | | SINTERED POROUS POLYPROPYLENE TUBE | |
| SACCHARIN [G/L] | | | | | | | | | |
| % SEEPAGE | 95 | 57 | 25 | 13.8 | 17.6 | 24.7 | 8 | 52 | 47.6 |

DISCUSSION OF RESULTS

1. Coumarin Consumption

100% Soluble Anode

The first series of tests were designed to confirm the Coumarin consumption for a nickel plating bath with no insoluble anodes (100% nickel anode).

Figure 5:
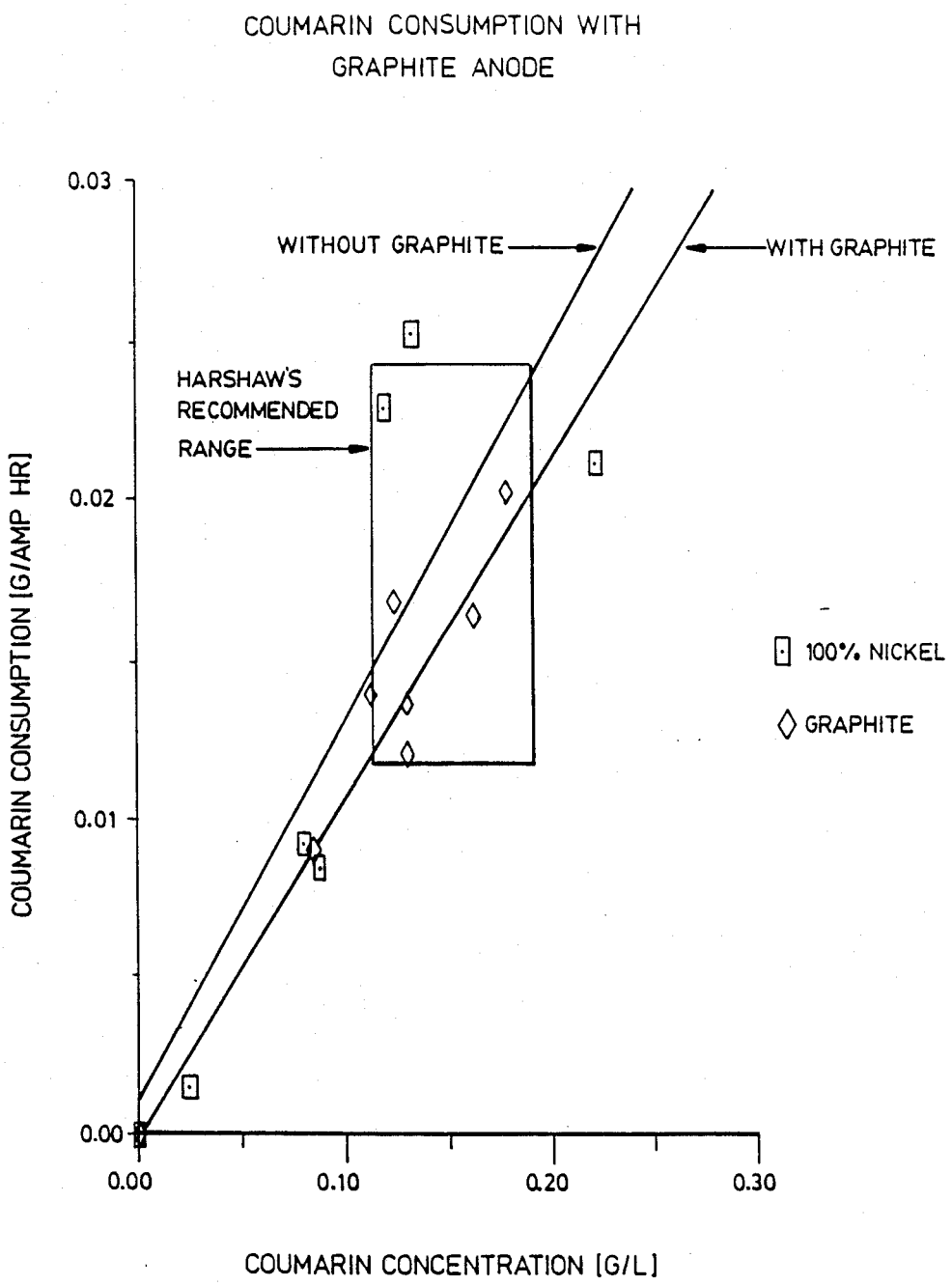
FIGS. 5, 6, 7, 8 and 9 are graphs illustrating certain aspects of experimental work conducted in accordance with the invention, as described hereinafter; and, FIG. 10 is a diagrammatic illustration of an anode compartment that may be used in the process of the invention.
Figure 6:
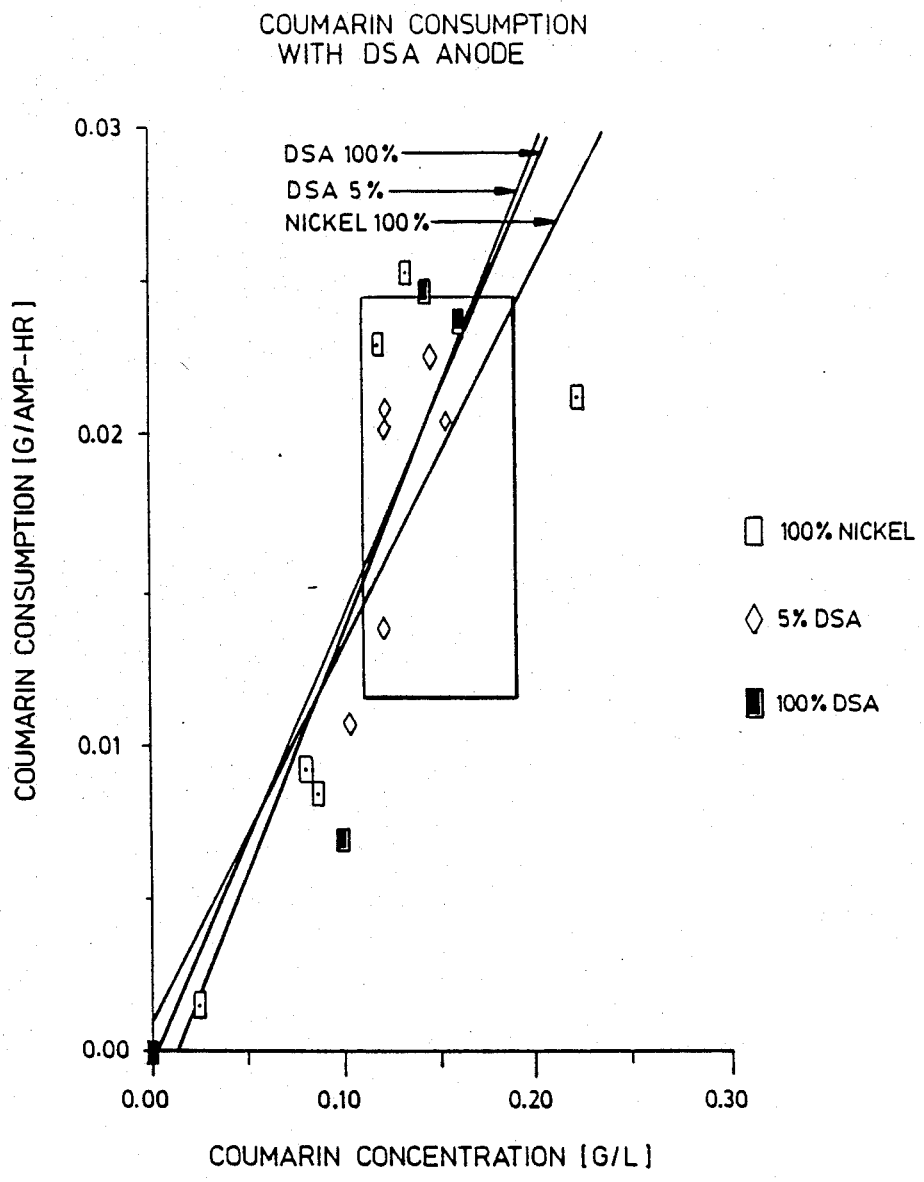

The suppliers of nickel plating addition agents recommend that the Coumarin concentration be maintained between 0.133 g/L and 0.183 g/L (0.8 to 1.1 g/L Perflow 104). In that range the consumption should be 0.012 to 0.024 g Coumarin/Amp-Hr (35,000 to 70,000 Amp-Hrs/U.S. Gal of Perflow 104). In the tests the Coumarin consumption varied with the concentration (FIG. 5). In the recommended range it was within the limits prescribed above.

The concentration of nickel in the solution was also monitored. During 21 hours of operation at a current of 150 amps the nickel concentration increased from 78.1 g/L to 79.4 g/L. Assuming 100% anode efficiency, this concentration change translates into a cathode efficiency of 96.6%.

Insoluble/Soluble Anodes

Graphite

In the second step of the test, a graphite anode was installed in the plating cell. A current of 4 to 8 amps, representing 3.5% to 5.5% of the total was diverted through the graphite. The current density ranged from 28 to 80 ASF at the graphite anode.

The Coumarin consumption was found to be virtually identical to that found without graphite. Consumption appears to be independant of auxiliary anode current density or the type of graphite used.

The change in chloride concentration was lower than expected. After 40 hours of continuous plating with the graphite anode, the chloride dropped from 9.1 g/l to 9.0 g/l. Based on this it can be calculated that only about 2% of the current passed through the graphite was used in the reaction to produce chlorine. This means that the important sulfate to chloride ratio in nickel plating will be easy to maintain. No chlorine odor was detected at any time during the tests. Therefore, no additional ventilation will be required.

The one problem encountered with the graphite was anode deterioration. After less than 30 hours of operation, all four types of graphite tested showed signs of flaking and erosion (Table 2). Phenolic resin impregnated graphite had the best durability, but after only 90 hours at 55 ASF, it had lost more than 18% of its original weight. This corresponds to an anode life of only 1-2 months under normal nickel plating conditions.

Precious Metal Coated Titanium

Figure 7:
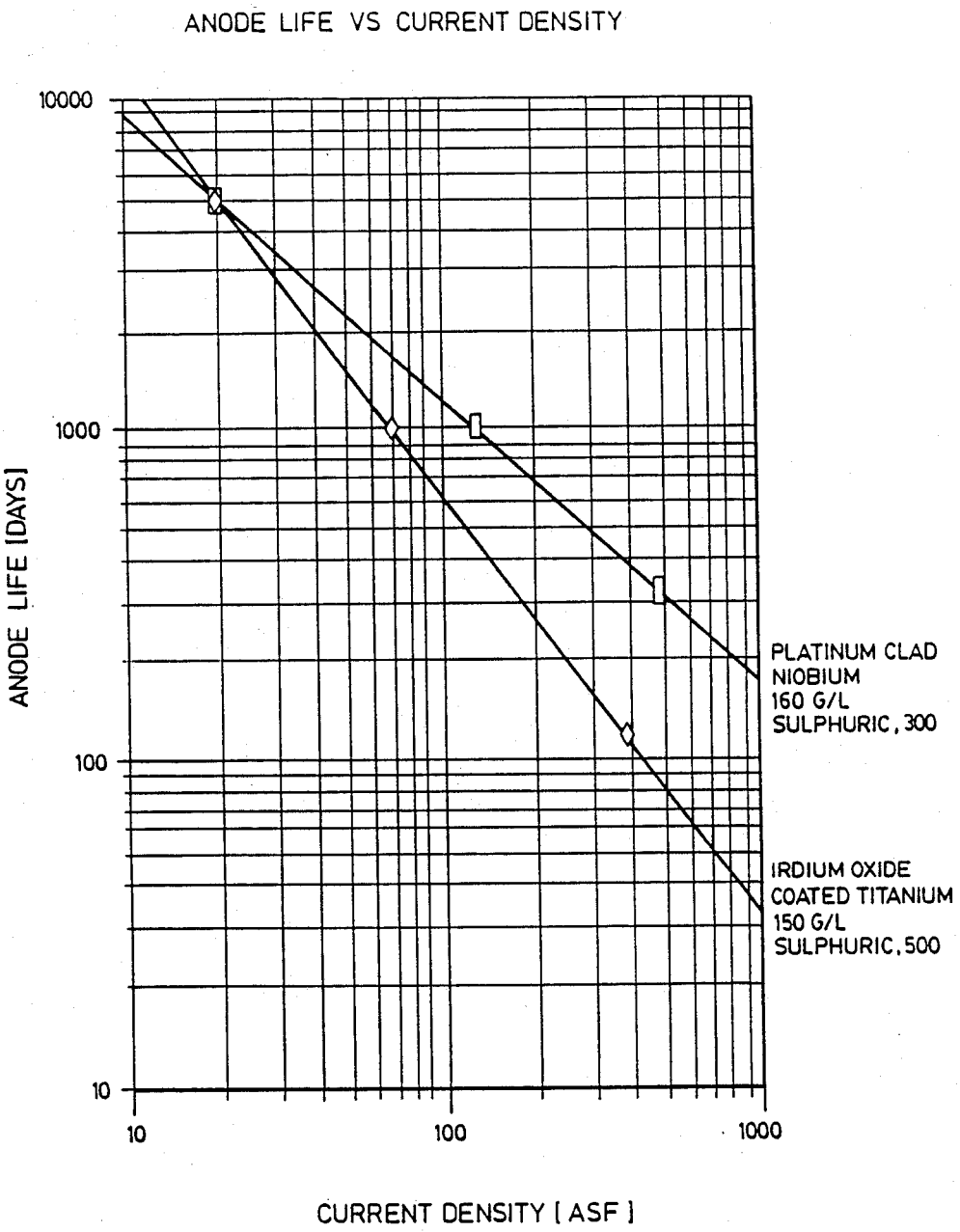

In the search for a more resilient insoluble anode, platinized titanium was given first consideration due to its frequent use as an auxiliary anode in electroplating. Platinized titanium has a good expected life in sulfuric acid (FIG. 7). However, chlorine evolution may have a negative effect, and certain brighteners (sulfur containing, first class) form complexes with platinum, accelerating dissolution. Platinized titanium would be a good choice in solutions containing primarily sulfate (i.e. very low chloride) such as acid copper sulfate plating. Indeed although life may be limited, it may be possible to utilize platinized titanium in nickel plating baths as well.

DSA also has extremely good anode life in sulfuric acid (FIG. 7), and chlorine evolution should extend it. Initial tests with DSA showed no increase in Coumarin consumption (FIG. 6), and chlorine evolution was negligible.

Although it was noted that the position of the insoluble anode with respect to the other soluble anodes affected the current carried by it, the proportion of the current carried by the insoluble anode was approximately equal to the proportion of the total anode area represented by the area of tee insoluble anode. It is therefore possible to vary the effective anode efficiency by varying the area of the insoluble anode and/or by varying its position with respect to the other soluble anodes.

2. Accelerated Life Test

Figure 8:
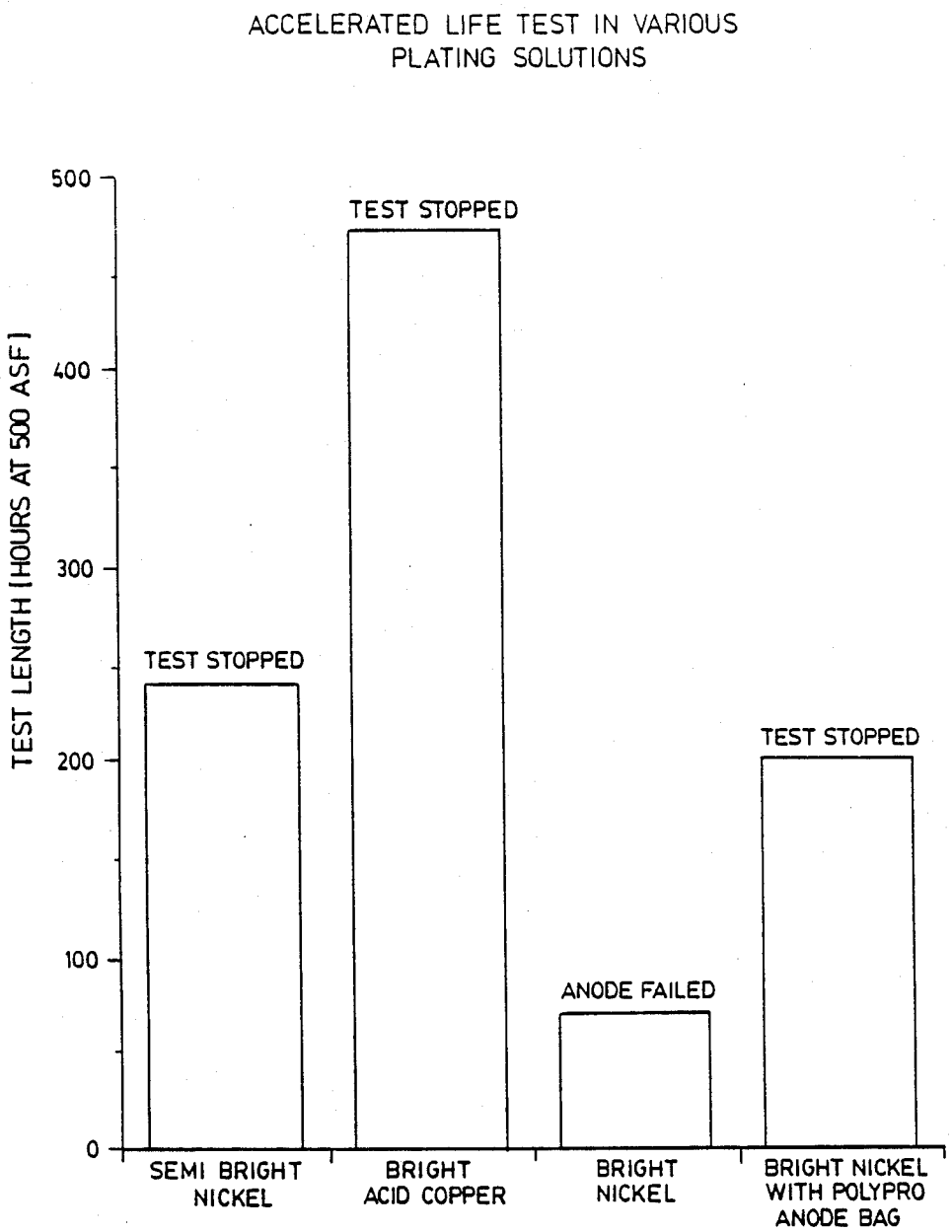

The results of the accelerated life test for DSA at 500 ASF in semi-bright nickel, bright nickel and bright acid copper are shown graphically in FIG. 8. The DSA anode in both the semi-bright and acid copper solutions showed no signs of deterioration at the end of testing, indicating minimum anode life of at least 1-2 years under normal conditions.

In the bright nickel the DSA anode failed after only 70 hours. At the end of the test only 25% of the initial current was flowing through the anode. Analysis by the anode manufacturer found a 50% loss of the iridium in the coating, leading to poor adhesion and almost total passivation. In both nickel solutions less than 1% of the current passed through the DSA went to the evolution of chlorine gas.

3. Anode Bag Test

The design of the anode bag system calls for a purified nickel salt solution recovered from the rinse water by ion exchange to be pumped into the anode bag. For a typical bumper plating tank with 5% insoluble anodes, the flow of recovered solution would be anywhere from one to five liters/hr for every square foot of anode bag area. The bag material must have a low porosity to prevent brighteners from seeping into the anode compartment. The concentration of one of the major brightener components (saccharin) inside the bag was measured with different bag materials at various flows (see FIG. 9).

The normal polypropylene bag used in the plating industry has a porosity rating of 20 to 30 CFM (cubic feet per minute). The rating is based on the flow of air through 1 square foot of cloth with a ½" water pressure differential. At a solution flux of 3 L/hr/ft$^2$ through this bag, the internal brightener concentration was 95% of the external.

Figure 9:
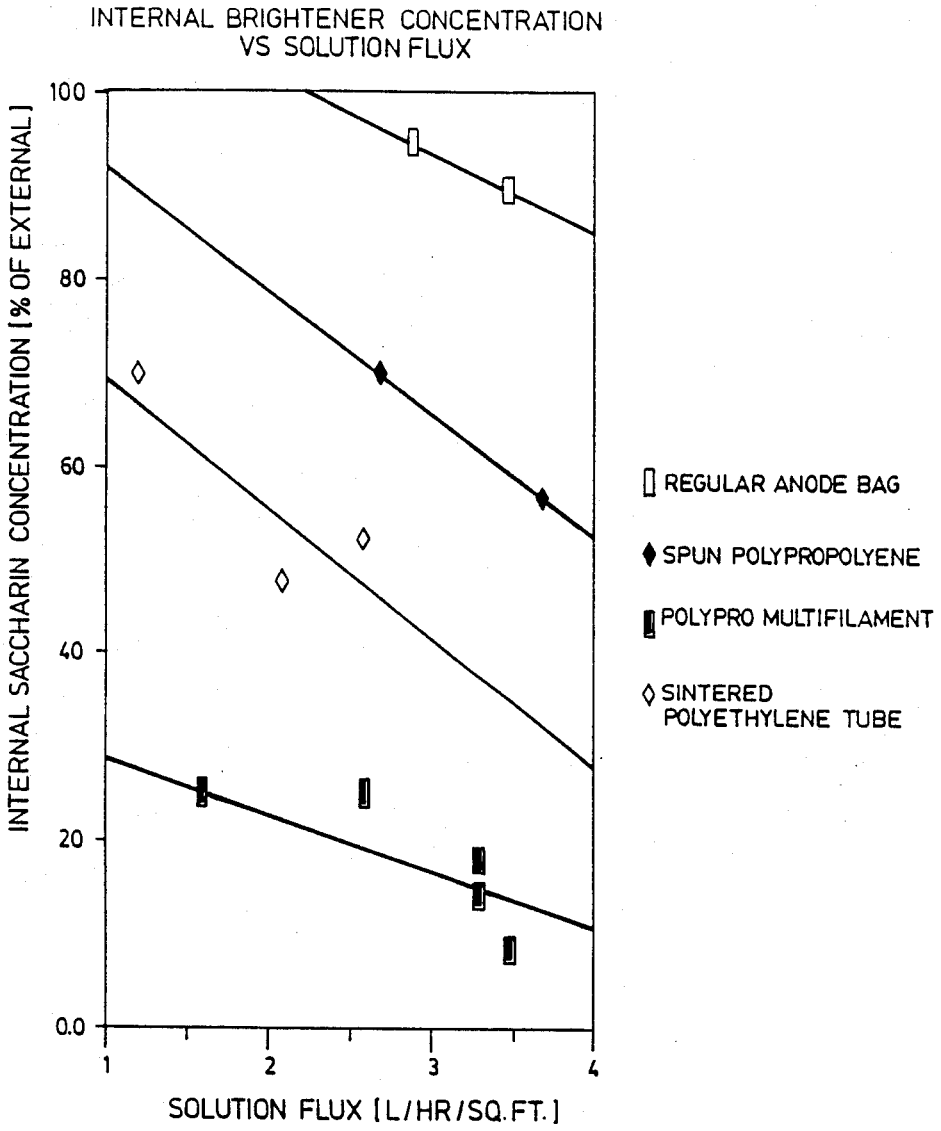

A number of other materials have been tested with far better results (Table 5, FIG. 9). The best was a polypropylene multi-filament with a porosity rating of 2–3 CFM. An accelerated life test was started on DSA using this material as the anode bag and a solution flux of 3 L/hr/ft$^2$. As shown in FIG. 8, the anode lasted four times longer than the same anode exposed to solution in the previous test. The test was stopped after 200 hours at 500 ASF and there was no sign of anode deterioration.

4. Ion Exchange Membrane Test

The ion exchange membrane assembly was operated at an anode current density of 50 amp/ft$^2$ and a voltage of 7 V to determine its effectiveness in rejecting brighteners and protecting the insoluble anode. A 1.0N solution of sulfuric acid was placed inside the compartment. The test was stopped after 200 hours. There was no sign of anode corrosion and the organic content of the sulfuric acid anolyte was 1 mg/L TOC, which is less than 0.1% of the external plating solution concentration. This indicates that the ion exchange membrane effectively rejected the brighteners and thereby protected the anode.

The electrical current was turned off. After 64 hours the brightener content was found to have risen to only 57 mg/L TOC. This is only 3.5% of plating bath concentration. This indicates that the membrane is very effective in rejecting the brighteners during a shutdown situation.

It was noted that the current was turned off that the hydrogen ions exchanged with nickel ions across the membrane as evidenced by a decrease in acid concentration from 1.0N to 0.5N and an increase in nickel concentration inside the anode compartment from 0 to 15 g/L over the 64 hour period. The concentrations reverted to their original concentrations very quickly after the current was resumed however and no adverse effects were observed because of this exchange of ions.

CONCLUSIONS (1) The use of insoluble anodes will allow the recycle of dragout metal salts to a nickel or copper plating bath.

(2) Coumarin consumption will not be affected by 3–7% insoluble anodes.

(3) Chlorine evolution is not significant in either semi-bright or bright nickel plating with insoluble anodes so that additional ventilation is not required.

(4) Iridium oxide coated titanium has all the characteristics required in an insoluble anode for Courman based semi-bright nickel and for the Harshaw Elecktra bright acid copper. The Harshaw DBN-bright nickel however greatly shortens anode life.

(5) By pumping purified nickel sulfate solution into a polypropolyene multi-filament anode bag, the insoluble anode can be protected from potentially damaging organic brighteners. Anode life can be extended by many times over that of an unprotected anode.

(6) By employing an ion exchange membrane to isolate the insoluble anode from the plating solution the anode life can be extended many times. The recovered nickel salt solution need not be free of brighteners in this particular configuration.

It should finally be noted that the preceding description refers, without limitation, to particular preferred embodiments of the invention. In particular, it should be noted that while specific reference has been made to nickel and copper plating the invention is not limited to the plating of nickel or copper and may be used in the plating of other materials capable of being deposited by electroplating. Examples are zinc and various alloys such as nickel/iron alloys.

Some examples of suitable insoluble anode materials have been given previously; they include graphite (with suitable protection), a titanium substrate with an iridium oxide or ruthenium oxide coating (e.g. DSA), chemical lead or a lead alloy, a valve metal substrate with a coating of platinum or a platinum group metal oxide. Another example of a suitable insoluble anode material is the Ebonex electrode which is a titanium oxide ceramic anode manufactured by Ebonex Technologies Inc.

I claim:

1. An apparatus for electroplating metals comprising:

at least one electroplating bath having an anode including soluble anode material in the form of the metal to be plated, and insoluble anode material, the bath being intended to receive a cathode comprising a wokkpiece to be plated, and the proportion of soluble anode material to insoluble anode material being selected so that the anode efficiency is substantially equal to the cathode efficiency during electroplating;

means for rinsing the workpiece after electroplating;

means for treating the rinse water to recover metal salt solution carried from the electroplating bath by the cathode; and, means for recycling the recovered salt solution to the electroplating bath to maintain the metal salt concentration in the bath within required limits.

2. An apparatus as claimed in claim 1, wherein the means for treating the rinse water comprises an ion exchange unit.

3. An apparatus as claimed in claim 1, wherein the anode comprises a bus bar and a series of anode elements electrically coupled to the bus bar, wherein at least one of those elements comprises insoluble anode material.

4. An apparatus as claimed in claim 1, further comprising a porous protective bag surrounding said insoluble anode material and isolating said material from potentially harmful agents within the bath, and wherein said means for recycling the recovered salt solution to the electroplating bath is arranged to deliver said solution into said protective bag.

5. An apparatus as claimed in claim 1, further comprising a compartment receiving at least some of said insoluble anode material and a highly conductive electrolyte, said compartment including a non-porous diaphragm separating and isolating said insoluble anode material from potentially harmful agents within the bath, said diaphragm comprising an ion exchange membrane.

6. For use in an apparatus as claimed in claim 1, a membrane separated anode compartment for receiving insoluble anode material and a highly conductive electrolyte, said compartment including a non-porous diaphragm for separating and isolating said insoluble anode material from potentially harmful agents within the bath, said diaphragm comprising an ion exchange membrane.

7. An apparatus as claimed in claim 3, wherein said anode elements each comprise a basket contained anode material, at least one of said baskets contains insoluble anode material in the form of an insoluble plate.

* * * * *